US005440285A

United States Patent [19]

Nakanishi et al.

[11] Patent Number: 5,440,285

[45] Date of Patent: Aug. 8, 1995

[54] CLOSED TYPE ELECTROMAGNETIC RELAY

[75] Inventors: Yoichi Nakanishi; Ryuichi Sato; Kazumi Sako; Masayuki Noda; Ikuo Takegahara, all of Kyoto, Japan

[73] Assignee: Omron Corporation, Kyoto, Japan

[21] Appl. No.: 133,197

[22] PCT Filed: Apr. 22, 1992

[86] PCT No.: PCT/JP92/00519

§ 371 Date: Oct. 20, 1993

§ 102(e) Date: Oct. 20, 1993

[87] PCT Pub. No.: WO92/19001

PCT Pub. Date: Oct. 29, 1992

[30] Foreign Application Priority Data

Apr. 22, 1991 [JP] Japan ..... 3-090453
May 1, 1991 [JP] Japan ..... 3-100119

[51] Int. Cl.[6] ..... H01H 51/22
[52] U.S. Cl. ..... 335/78; 335/202
[58] Field of Search ..... 335/78–86, 335/124, 128, 130, 131, 202

[56] References Cited

U.S. PATENT DOCUMENTS 4,517,537 5/1985 Weiser et al. .
4,912,438 3/1990 Yokoo ..... 335/78
5,270,674 12/1993 Nakanishi et al. ..... 335/78

FOREIGN PATENT DOCUMENTS

0129068A1 5/1984 European Pat. Off. .
0129068B1 4/1987 European Pat. Off. .
3318493A1 11/1984 Germany .

OTHER PUBLICATIONS

Japanese Utility Model Laid-Open Publication No. 51-162950, published Dec. 25, 1976.
Japanese Utility Model Laid-Open Publication No. 47-29436, published Dec. 4, 1972.
Japanese Patent Laid-Open Publication No. 59-224024, published Dec. 15, 1984.

*Primary Examiner*—Lincoln Donovan
*Attorney, Agent, or Firm*—Fish & Richardson

[57] ABSTRACT

In this closed type electromagnetic relay, an insulating resin is injection molded to the surface of a coil block so that a part of a coil wound around an iron core at the side opposite a contact opening/closing mechanism is exposed. A force exerted on the coil by the resin pressure during injection molding is relieved by the exposed part, and a gas generated from the coil or the like after the injection molding is discharged out through the exposed part. Accordingly, the coil block is easily coated with the insulating resin without fears that the coil is broken at sealing time or the coated resin is broken after sealing.

2 Claims, 2 Drawing Sheets

CLOSED TYPE ELECTROMAGNETIC RELAY

FIELD OF THE INVENTION

The present invention generally relates to a closed type electromagnetic relay, and more particularly to a closed type electromagnetic relay with the characteristic insulating structure of a coil block.

BACKGROUND OF THE INVENTION

In a conventional electromagnetic relay of a closed type intended to guard against the ambient atmosphere, a coil block, which is an internal component of the electromagnetic relay, has sometimes been coated with an insulating resin through injection molding to enhance the insulating properties between a coil of the coil block and a contacting point.

To seal the electromagnetic relay of the above-described type, the electromagnetic relay is first installed in the vacuum space at high temperatures for vacuum process. After the air inside the electromagnetic relay is discharged and an inert gas fills the electromagnetic relay in the inert gas atmosphere, the electromagnetic relay is sealed.

Meanwhile, an example of a compact-size electromagnetic relay such as proposed in Japanese Patent Laid-Open Publication No. 02-319922 (319922/1990) secures an insulation distance between the coil and contacting point by providing an insulating member between a movable block arranged at the lower side of the coil block and the coil block.

If the insulating resin is coated all over the coil winding section of the coil block through injection molding, it is necessary for a mold to be vented in order to prevent a short shot (insufficient filling) or a burn mark, and moreover, it is quite difficult to set the molding conditions, e.g., injection pressure, temperatures of the mold and the like.

Since the electromagnetic relay is put in the high temperature atmosphere during the vacuumizing process, the coated resin may be broken by the gas generated from the coil or the like, thus making it hard to obtain a desired dielectric strength between the coil and contacting point.

Moreover, an extraordinary force exerted on the coil resulting from the pressure of the resin during injection molding causes the coil to break in some cases.

SUMMARY OF THE INVENTION

The present invention provides a closed type electromagnetic relay which substantially eliminates the above-described inconveniences inherent in the prior art, whereby a coil block is easily coated with an insulating resin without causing coil to break during sealing or the coated resin to break after sealing.

In the conventional electromagnetic relay, the insulating member is processed separately beforehand, so that the number of components of the electromagnetic relay is disadvantageously increased. The positioning accuracy is accordingly required to be tight. Otherwise, the distance between a fixed contacting point of a fixed contact element integrally formed with the insulating member and a movable contacting point of a movable block is prone to vary. What's worse, the insulation distance secured by the insulating member is not enough.

Accordingly, the present invention also provides an electromagnetic relay having superior insulating properties in which the distance between contacting points can be set correctly.

In order to accomplish the above-described advantages of the present invention, a sealed type electromagnetic type is provided which has a contact opening/closing mechanism arranged in the vicinity of a coil block consisting of a coil wound around an iron core. An insulating resin is injection molded to the surface of the coil block so that a part of the side opposite the contact opening/closing mechanism of the coil block is exposed. The force impressed to the coil from the resin pressure during injection molding is eased by the exposed part and moreover the gas generated from the coil or the like after injection molding is discharged through the exposed part.

In another aspect of an electromagnetic relay of the present invention, fixed contact elements are integrally formed by the forming process with a coil block comprising a coil wound around an iron core. The coil block is resin molded at least up to a part at the side opposite the fixed contact elements. According to the forming process, not only the coil is insulated, but also the fixed contact elements are insertion molded and correctly positioned.

DETAILED DESCRIPTION OF THE INVENTION

A closed type electromagnetic relay according to a first embodiment of the present invention will be discussed with reference to FIG. 1.

Figure 1:
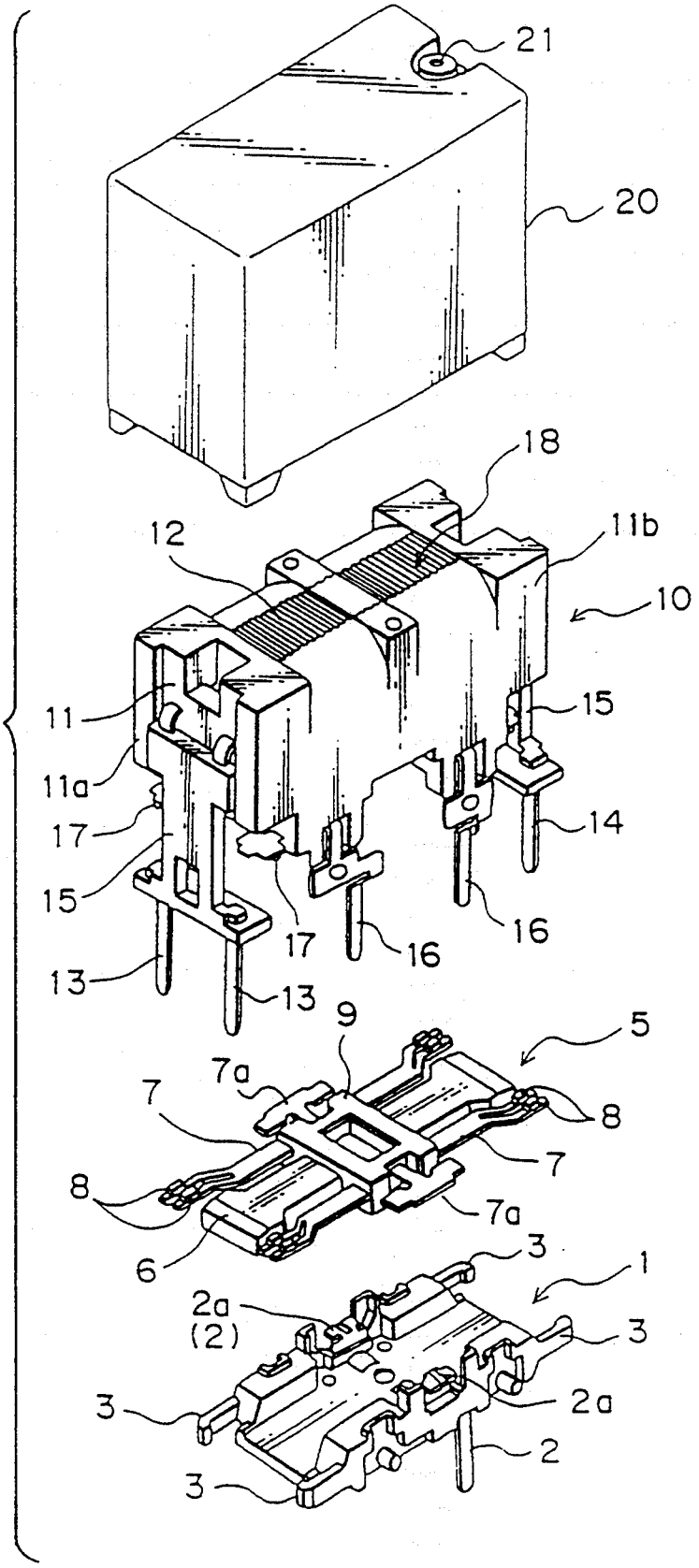
FIG. 1 is an exploded perspective view of an electromagnetic relay according to a first embodiment of the present invention.

FIG. 1 is an exploded perspective view of the electromagnetic relay with a coil block having an insulating structure characteristic of the present invention. The electromagnetic relay comprises a base block 1, a movable block 5, a coil block 10 and a casing 20.

The plate-like base block 1 made of synthetic resin has common terminals 2, 2 integrally formed therewith so that welding parts 2*a*, 2*a* project upward at the central part of each longitudinal side of the plate. A pair of engaging hooks 3 confront each other at either end of the longitudinal side of the base block.

The movable block 5 comprises a movable iron piece 6 and a pair of movable contact elements 7 arranged at each longitudinal side of the movable iron piece 6 which are integrally joined by a central supporting part 9. Movable contacting points 8 are formed at each end of the movable contact element 7. A generally T-shaped connecting part 7*a* extends from the central part of the movable contact element 7 at the lateral side of the central supporting part 9.

In the coil block 10, a coil 12 is wound around an iron core (not shown) via a spool 11. A pair of coil terminals 13, 13 and a pair of terminal members 14, 14 are insertion-molded in the respective jaws 11*a*, 11*b* at both ends of the coil block 10. A leg part of each terminal protruding from the end face of the spool 11 (jaw 11*a*, 11*b*) is integrally coupled by a side plate 15.

An insulating resin enters from below the coil block 10 during the forming process. During forming, four fixed contact elements 16 are insertion-molded below the spool 11 and at the same time, the outer periphery of the coil 12 and the winding part (not shown) of the coil terminals 13 are resin-molded. The coil 12 is resin-molded to allow a short shot so that an exposed part 18 is formed in the upper part of the coil 12. Therefore, a force impressed to the coil 12 from the resin pressure is moderated by the exposed part 18, thereby preventing the coil 12 from being broken. A fixed contacting point 17 of the fixed contact element 16 extends from both ends of the spool 11. The fixed contacting point 17 contacts and disengages from the movable contacting point 8 of the movable block 5.

The assembly of the electromagnetic relay in the above-described structure will be described below.

The movable block 5 is mounted to the base block 1 in a swaying fashion so that the connecting part *7a* contains the confronting welding part *2a*. An edge of the surface where the connecting part *7a* and welding part *2a* contact each other is laser welded. While the side faces and bottom face of the base block 1 are softly supported by the leg parts of the fixed contact elements 16, the leg parts of the coil terminals 13 and terminal members 14 are bent to fixedly engage the side plate 15 into the engaging hooks 3 of the base block 1. The coil block 10 is hence mounted on the base block 1. Subsequently, the casing 20 is put over the base block 1.

In order to seal the electromagnetic relay, the relay is vacuum baked. At this time, although the coil 12 and the like generate gas since the vacuum baking process is carried out in a high temperature atmosphere, the gas is discharged from the exposed part 18 in the upper part of the spool 11 and released to the outside along with the internal gas in the electromagnetic relay from a sealing hole 21 formed in the casing 20. Therefore, a break of the molded part is prevented, unlike in the conventional example. Thereafter, an inert gas is sealed in the electromagnetic relay. The electromagnetic relay of the present invention is thus completed.

As is clear from the foregoing description, according to the closed type electromagnetic relay of the first embodiment of the present invention, an exposed part is formed at part of the winding section of the coil block when the coil block is coated with an insulating resin. Therefore, it is not necessary to vent the mold to prevent burning or the like or to adjust injection conditions such as the injection pressure.

Moreover, since the force exerted on the coil when the coil block is injection-molded is relieved by the exposed part 18, the inconvenience of a broken coil is eliminated.

Further, even if gas is generated from the coil, after the injection molding, the gas is discharged from the exposed part and therefore, there is no fear of breaking the coating of the insulating resin.

Figure 2:
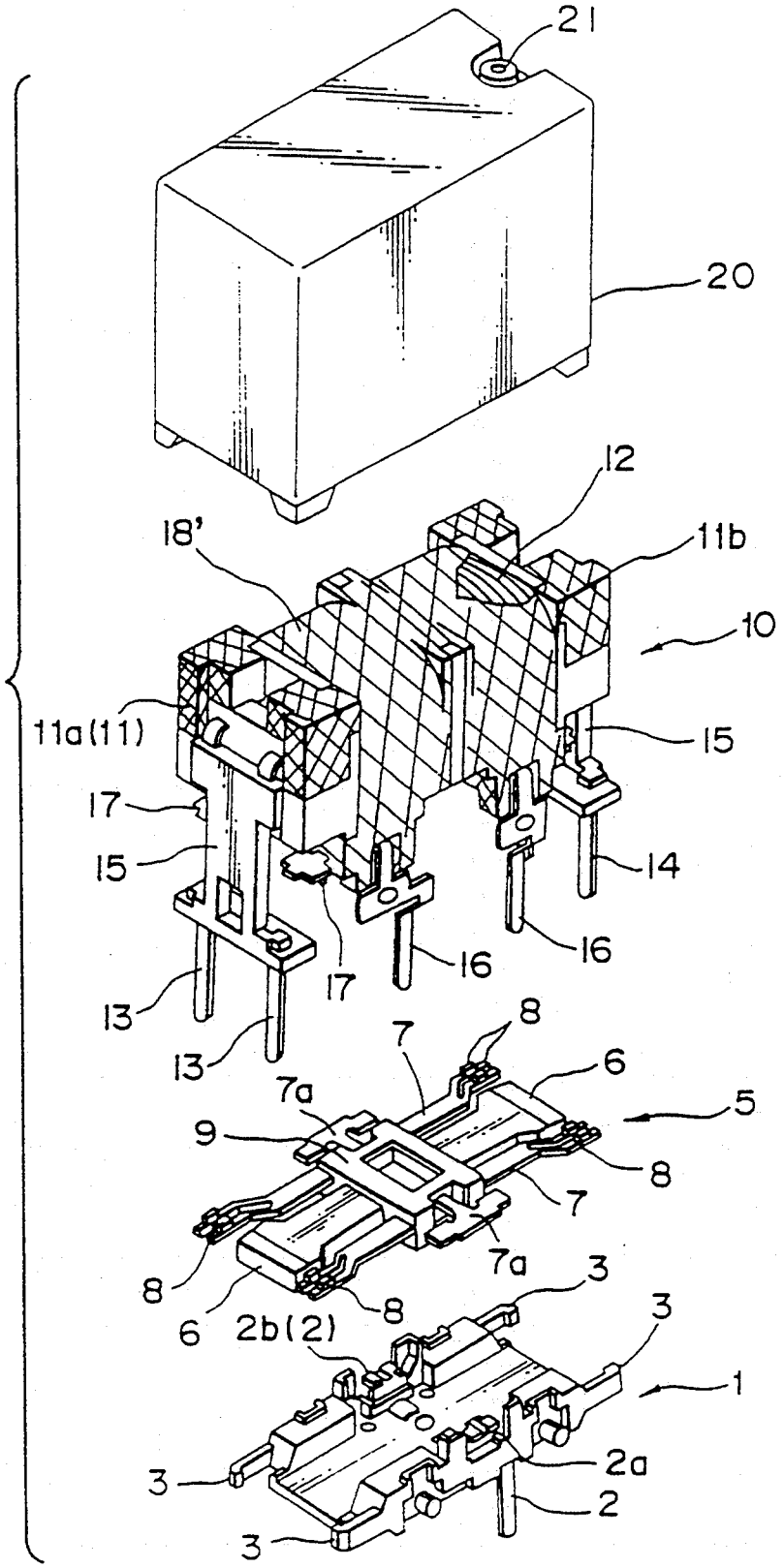
FIG. 2 is an exploded perspective view of a modification of the electromagnetic relay of FIG. 1.

FIG. 2 is an exploded perspective view of a modified electromagnetic relay which is generally similar to the first embodiment of FIG. 1. In the modified example, when the insulating resin enters from below the coil block 10 by the forming process, four fixed contact elements 16 are insertion-molded below the spool 11. The outer periphery of the coil 12 and the winding section (not shown) of the coil terminals 13 are resin-molded to form an insulating coating part 18' (indicated by an oblique line in the drawing). Fixed contacting points 17 of the fixed contact elements 16 are extended at both ends of the spool 11 to be in touch or out of touch with the movable contacting points 8 of the movable block 5.

As described hereinabove, since the fixed contact elements 16 are insertion-molded at the same time as the forming process of the coil block 10, a special member such as a base block or the like is not needed to position the fixed contact elements 16. In comparison with the case where the fixed contact elements 16 are integrally formed with the separate member, not only is the positioning accuracy improved, but also the insulation between the coil 12 and contacting points 8, 17 is positively ensured. In addition, since the whole of the winding section is resin-molded, a break of the coil is prevented even if the other member contacts the winding section. When the coil block is incorporated into the electromagnetic relay, although an inorganic gas may be generated from the coated resin due to the generation of heat of the coil 12, the gas is prevented from leaking outside and adhering to the surface of the contacting points thereby causing improper connection.

The electromagnetic relay of the above-described structure is assembled in the same manner as the first embodiment of FIG. 1.

In the modified example of FIG. 2, the insulating coating part 18' is formed by resin-molding the entire winding section of the coil block 10. However, it may be possible to form an opening, instead of the insulating coating part 18', by a short shot in the upper part of the coil block 10, namely, at the side opposite the fixed contact elements 16. It is advantageous to avoid a break in the coil 12 from the resin pressure during the forming process.

As is described hereinabove, according to the modified embodiment of the present invention, the winding section of the coil is coated with the insulating resin through the forming process, thereby obtaining high insulating properties between the contacting points and coil.

INDUSTRIAL APPLICABILITY

The closed type electromagnetic relay of the present invention has superior insulating properties in a simple structure, wherein the distance between the contacting points and coil can be set correctly. According to the present invention, the coil block is easily coated with the insulating resin, without inconveniences such as coil a broken at the sealing time or coated resin after the sealing process.

What is claimed is:

1. A closed type electromagnetic relay comprising a contact opening/closing mechanism arranged in the vicinity of a coil block consisting of a coil wound around an iron core, wherein an insulating resin is molded in injection to the surface of said coil block so that a part of said coil block at the other side than said contact opening/closing mechanism is exposed to outside.

2. A closed type electromagnetic relay which comprises a coil block consisting of a generally U-shaped iron core with confronting magnetic pole elements bent at both ends thereof and a coil wound around said iron core via a spool, and a movable block supported in a swaying fashion generally centering the central part thereof with both ends opposed to said magnetic pole elements, so that said movable block is swayed in accordance with the magnetization and demagnetization of said coil block thereby to bring movable contact elements of said movable block in touch with fixed contact elements of said coil block, wherein said fixed contact elements of the coil block are integrally molded with said spool in the vicinity of a coil winding section at the lower side of said spool in the postforming process, to which spool are inserted said iron core and coil terminals in a manner to expose the magnetic poles of said iron core at the lower side of flanges at both ends of said coil block, and a winding part of said coil terminals at least at either of said flanges, said coil block being processed and coated through resin molding to expose a part above the surface of said coil winding section.

* * * * *